US007371132B2

(12) United States Patent
Tanaka

(10) Patent No.: US 7,371,132 B2
(45) Date of Patent: May 13, 2008

(54) TERMINAL FITTING AND A CONNECTOR PROVIDED THEREWITH

(75) Inventor: Tsutomu Tanaka, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 11/598,297

(22) Filed: Nov. 13, 2006

(65) Prior Publication Data

US 2007/0111614 A1 May 17, 2007

(30) Foreign Application Priority Data

Nov. 15, 2005 (JP) ..... 2005-330102

(51) Int. Cl.
*H01R 13/11* (2006.01)

(52) U.S. Cl. ..... 439/752.5; 439/852

(58) Field of Classification Search ..... 439/752.5, 439/839, 841, 851, 852
See application file for complete search history.

(56) References Cited

U.S. PATENT DOCUMENTS 5,443,592 A * 8/1995 Ittah et al. ..... 439/851
6,068,524 A 5/2000 Koumatsu
6,152,788 A 11/2000 Hata et al.
6,524,143 B2 * 2/2003 Chen ..... 439/852
6,527,601 B2 * 3/2003 Chen ..... 439/852
6,981,900 B2 * 1/2006 Sakurai et al. ..... 439/752.5
2001/0051472 A1 12/2001 Sato et al.
2002/0022412 A1 2/2002 Alonson Merino et al.
2002/0076999 A1 6/2002 Chen
2002/0086590 A1 7/2002 Mitani et al.
2005/0164567 A1 7/2005 Sawada et al.
2007/0111613 A1 * 5/2007 Kumakura ..... 439/851
2007/0111614 A1 * 5/2007 Tanaka ..... 439/852

* cited by examiner

*Primary Examiner*—James Harvey
(74) *Attorney, Agent, or Firm*—Gerald E. Hespos; Anthony J. Casella

(57) ABSTRACT

A terminal fitting (3) has a tubular main portion (6), and a stabilizer (17) embossed to project out from a side wall (6B) of the main portion (6). The stabilizer (17) can be received in a guiding recess (18) in a cavity (2). A resilient tongue (14) is folded back from the front of a bottom wall (6A) of the main portion (6) and into the main portion (6). Preventing pieces (14B) bulge from widthwise edges of the tongue (14). One preventing piece (14B) is engageable with a first preventing portion (16A) made in the side wall (6B) upon forming the stabilizer (17). Accordingly, the stabilizer (17) and the first preventing portion (16A) can be at the same site, which contributes to the miniaturization and increases locations where other parts can be formed.

14 Claims, 12 Drawing Sheets

TERMINAL FITTING AND A CONNECTOR PROVIDED THEREWITH

BACKGROUND OF THE INVENTION

1. Field of the Invention

The invention relates to a terminal fitting and to a connector provided therewith.

2. Description of the Related Art

U.S. Pat. No. 6,068,524 discloses a terminal fitting with a main portion that can be inserted into a cavity of a connector housing. An inner wall of the main portion is embossed to define an outwardly projecting stabilizer that can be inserted into a recess formed in an inner wall of the cavity. The stabilizer must align with the recess, and hence prevents an erroneous insertion of the terminal fitting into the cavity. On the other hand, U.S. Patent Application Publication No. 2005/0164567 discloses a terminal fitting that has a tongue and preventing pieces that bulge out at the opposite widthwise edges of the tongue. Openings are formed in side surfaces of the main portion and receive the preventing pieces so that the preventing pieces engage the edges of the openings. FIG. 14 shows a hypothetical terminal fitting 103 that simply combines the features of these two references. The front half of the terminal fitting 103 has preventing pieces 114B and preventing portions 116A to prevent excessive deformation and the rear half of the terminal fitting 103 has a stabilizer 117 to prevent erroneous insertion of the terminal fitting 103.

The excessive deformation preventing portions and the erroneous-insertion preventing portion are arranged independently and respectively require spaces. As a result, locations for other functional parts are limited, thereby causing a problem of a reducing design freedom and complicating efforts to miniaturize the terminal fitting 103.

The invention was developed in view of the above problem and an object thereof is to extend functional parts while improving design freedom.

SUMMARY OF THE INVENTION

The invention relates to a terminal fitting with a substantially tubular main portion for accommodation in a cavity that penetrates a connector housing substantially in forward and backward directions. A tongue is in the main portion and is resiliently deformable along a height direction. At least one projection bulges out from at least one lateral edge of the tongue, and at least one preventing portion is formed on a side surface of the main portion substantially facing the projection. The projection engages the preventing portion to prevent an excessive deformation of the tongue. At least one protrusion projects out on the side surface to prevent an erroneous insertion of the terminal fitting. The preventing portion is formed at or near a boundary edge between the projection and the side surface around the protrusion. The erroneous-insertion preventing portion and the excessive deformation preventing portion are at substantially the same location, thereby contributing to miniaturization of the terminal fitting and ensuring a location for another functional part to increase a degree of freedom in design.

The at least one protrusion preferably is formed by embossing a part of the inner wall of the side surface to project out and prevents an erroneous insertion of the terminal fitting. More particularly, the protrusion may be formed by embossing a part of the side surface between two or more slits extending substantially in a longitudinal direction and spaced apart in a height direction. Edges of a part where the slits are made serve as the preventing portion, and can be flat to prevent the excessive deformation. Further, the protrusion can bulge out a large amount to improve an erroneous insertion preventing function.

Substantially the entire surface of the protrusion may be continuous with the side surface without any interruption. Thus, the protrusion can be a closed structure that prevents external matter from entering the main portion.

Supporting surfaces preferably project from the side surfaces and support a portion of the tongue when the tongue is deformed.

The tongue preferably is supported at two portions separated in longitudinal direction, at least when the tongue is deformed.

An extending end of the tongue preferably contacts a support raised from the side surface at least when the tongue is deformed.

The invention also relates to a connector comprising a housing. A cavity penetrates the housing substantially in forward and backward directions and at least one of the above-described terminal fittings is accommodated in the cavity.

At least one lock preferably is arranged in the cavity for locking the terminal fitting therein. The locking portion has a base and a locking projection projects from the inner surface of the base in a direction intersecting the forward and backward directions. The locking projection is in a locking hole of the terminal fitting when the lock locks the terminal fitting, so that a reference surface between the base and the locking projection is substantially flush with a plane of opening of the locking hole.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
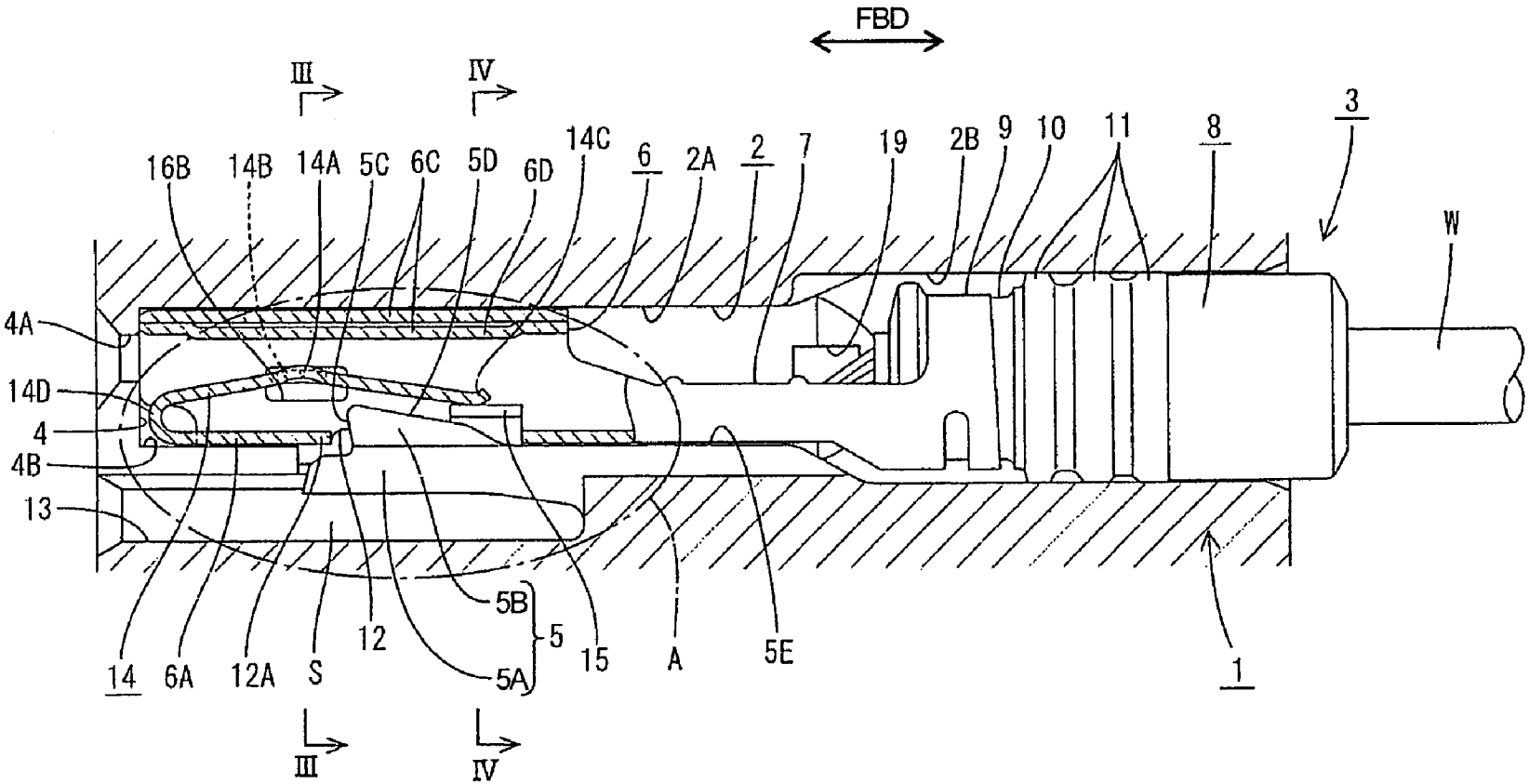
FIG. 1 is a longitudinal section showing a state where a lock is in a main portion of a first embodiment of the invention.
Figure 2:
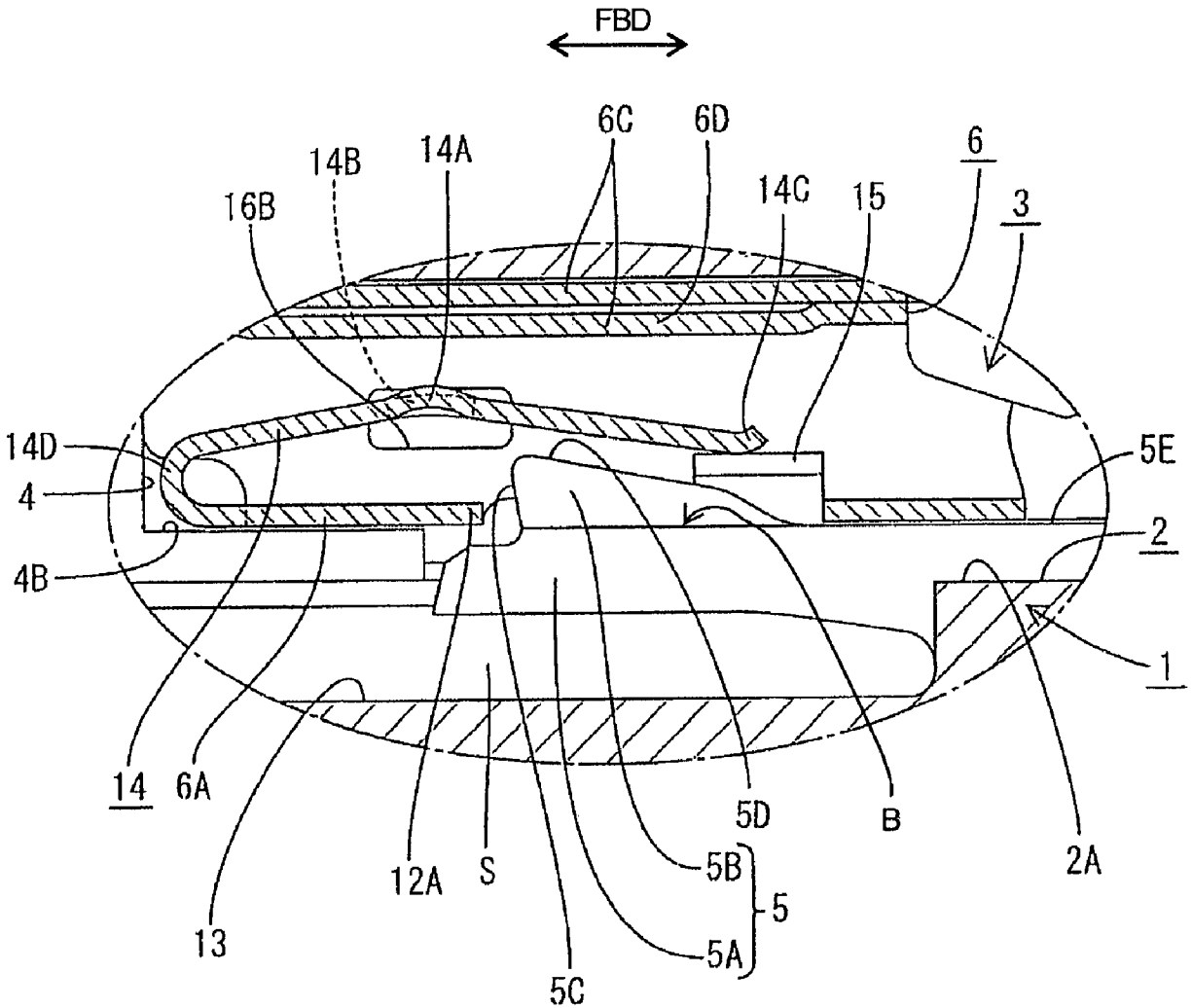
FIG. 2 is an enlarged view of a portion A in FIG. 1.
Figure 3:
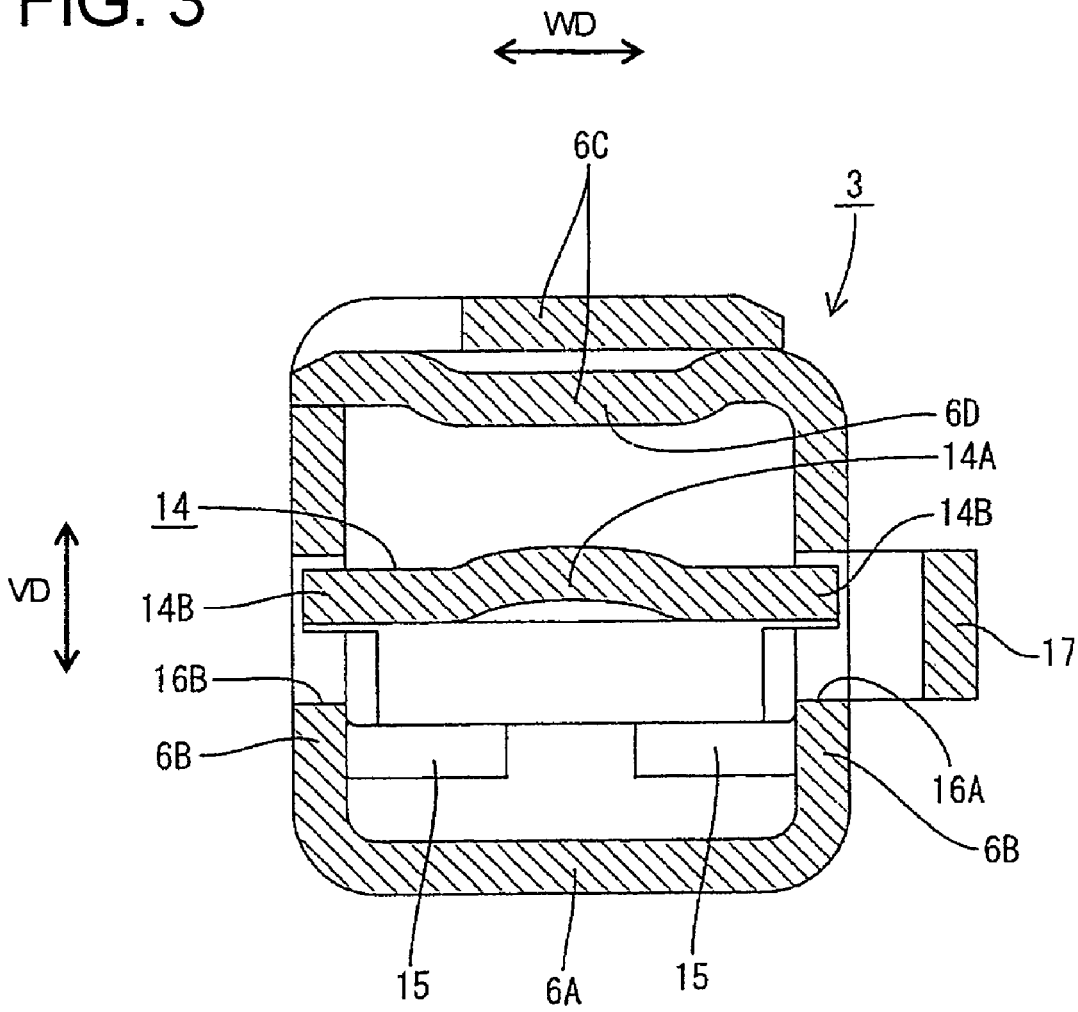
FIG. 3 is a section along III-III of FIG. 1.

A connector according to a first embodiment of the invention is described with reference to FIGS. 1 to 12. The connector includes a housing 1 with opposite front and rear ends that are spaced apart in forward and backward directions FBD. The front end of the housing 1 is the end that is to be connected with a mating connector. A cavity 2 penetrates through the housing 1 substantially in the forward and backward directions FBD. A terminal accommodating hole 2A is defined at a front portion of the cavity 2 and has a substantially rectangular cross section. A plug mounting hole 2B is defined at a rear portion of the cavity 2 and has a substantially round cross section. A terminal fitting 3 can be accommodated into the cavity 2 from behind as shown in FIG. 1. The terminal fitting 3 is stopped at its front position by a front wall 4 of the cavity 2, and is prevented from coming out backward by a lock 5 in the cavity 2. Further, a male-tab insertion hole 4A is formed in the front wall 4 for receiving a male tab (not shown) in a mating housing.

Figure 7:
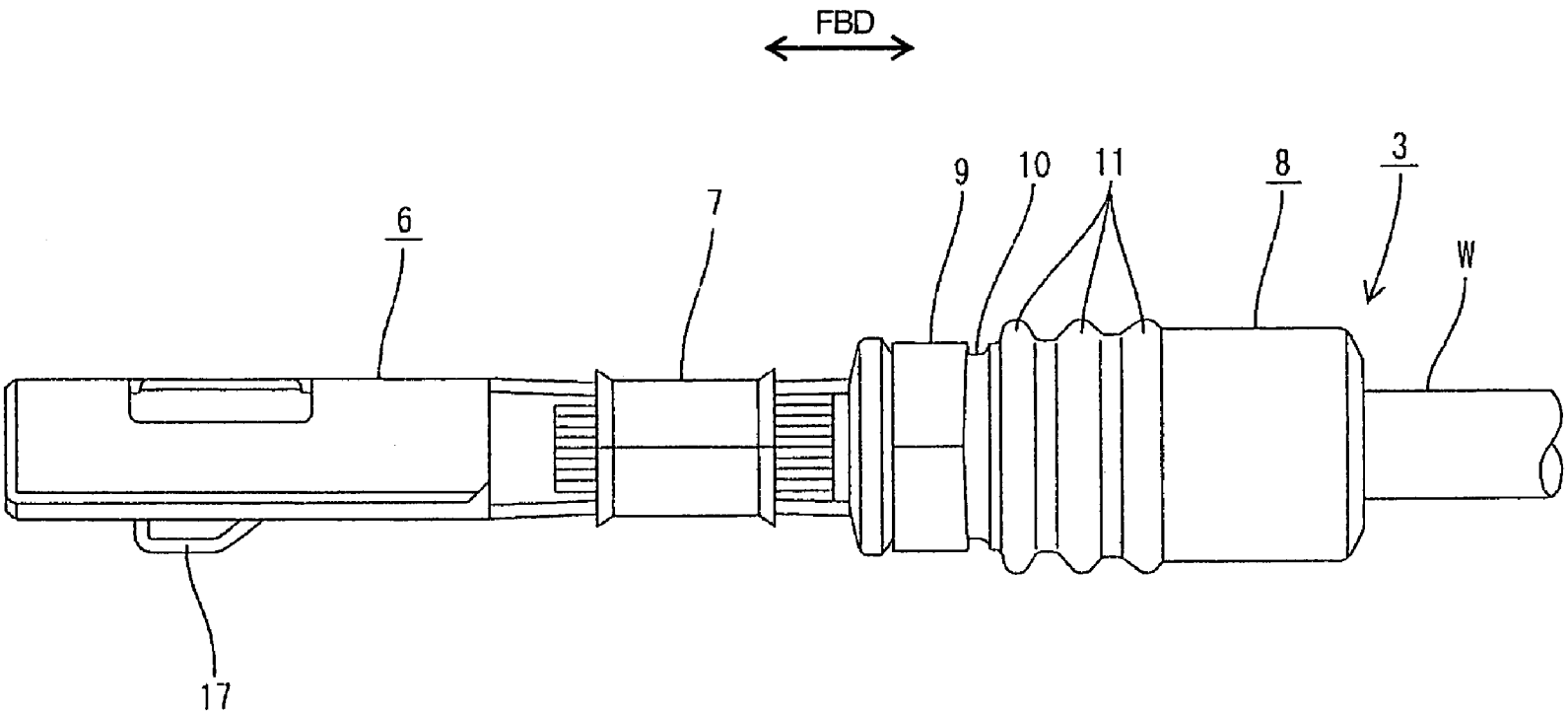
FIG. 7 is a plan view of a terminal fitting.

The terminal fitting 3 is formed by punching, cutting and/or press-forming a conductive metal sheet out and bending, embossing and/or folding the punched-out sheet. As shown in FIG. 7, the terminal fitting 3 has opposite front and rear ends that are spaced apart along forward and backward directions FBD, and a rectangular tubular main portion 6 is defined at the front end of the terminal fitting 3. A wire connection barrel 7 is behind the main portion 6 and is to be connected crimped, bent or folded into connection with a conductor of a wire W. An insulation barrel 9 is disposed behind the wire connection barrel 7 and is configured to be crimped, bent or folded into connection with a resilient plug 8 mounted over the insulation coating of the wire W. The main portion 6 is accommodated in the terminal accommodating hole 2A when the terminal fitting 3 is inserted into the cavity 2, and the plug 8 is accommodated in the plug mount hole 2B.

The plug 8 is made of a resilient material, such as silicon, and has a substantially cylindrical shape. A wire insertion hole penetrates the center of the plug 8 in substantially forward and backward directions FBD. An end of the wire W is inserted into the wire insertion hole, so that the plug 8 can be mounted on the insulation coating. A fastening portion 10 extends around the outer circumferential surface of the front end of the resilient plug 8, and the insulation barrel 9 is crimped, bent or folded around the fastening portion 10 to hold the rubber plug 8 in the terminal fitting 3. Lips 11 are formed circumferentially on the outer surface of the resilient plug 8 behind the fastening portion 10 and are spaced at specified intervals in forward and backward directions FBD. The lips 11 project radially out, and closely contact the inner circumferential surface of the resilient-plug mount hole 2B to prevent entry of fluids, such as water, to the inside through the plug mount hole 2B when the resilient plug 8 is inserted into the cavity 2.

Figure 12A:
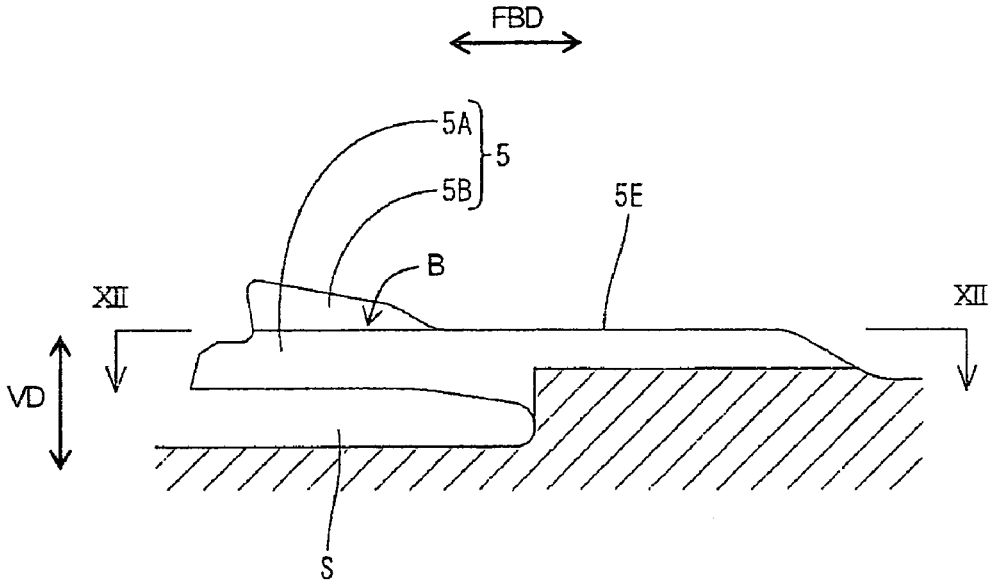
FIG. 12(A) is an enlarged view of a lock in FIG. 1
Figure 12B:
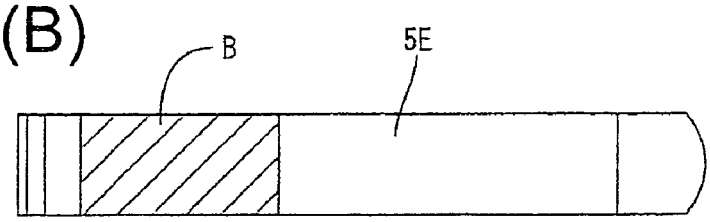
FIG. 12(B) is a section along XII-XII.

The lock 5 cantilevers forward from the bottom surface of the terminal accommodating hole 2A and is resiliently deformable towards a deformation space S below the lock 5. The lock 5 has a base 5A that extends forward from the back of the deformation space S and a locking projection 5B that projects up from the front end of the base 5A. The locking projection 5B is narrowed towards the top. FIG. 12(B) is a section along a horizontal reference plane B at a boundary between the base 5A and the locking projection 5B of FIG. 12(A). The normal vector of the reference plane B is substantially normal to the forward and backward directions FBD. A rib projects up from the bottom surface of the terminal accommodating hole 2A and extends rearwardly from the lock 5. The rib has the same width as the base 5A of the lock 5. A horizontal contact surface 5E extends continuously rearward from the locking projection 5B along the upper surface of the base 5A of the lock 5 and along the upper surface of the rib. The contact surface 5E is substantially coplanar with the reference plane B. A bottom surface 6A of the main portion 6 of the terminal fitting 3 slides on and is supported by the contact surface 5E when the terminal fitting 3 is being inserted into the terminal accommodating hole 2A. The terminal fitting 3 causes the lock 5 to deform into the deformation space S as the terminal fitting 3 is being inserted. However, the lock 3 restores resiliently when the locking projection 5B aligns with a locking hole 12 in the bottom surface 6*a* of the main portion 6 of the terminal fitting 3. The entire height and width of the locking projection 5B is in the locking hole 12 when the lock 5 is restored. Accordingly, the reference plane B substantially aligns with a plane of opening of the locking hole 12 when the lock 5 engages the terminal fitting 3 to define a large shear surface to resist a shear force exerted when the terminal fitting 3 is pulled back.

Figure 8:
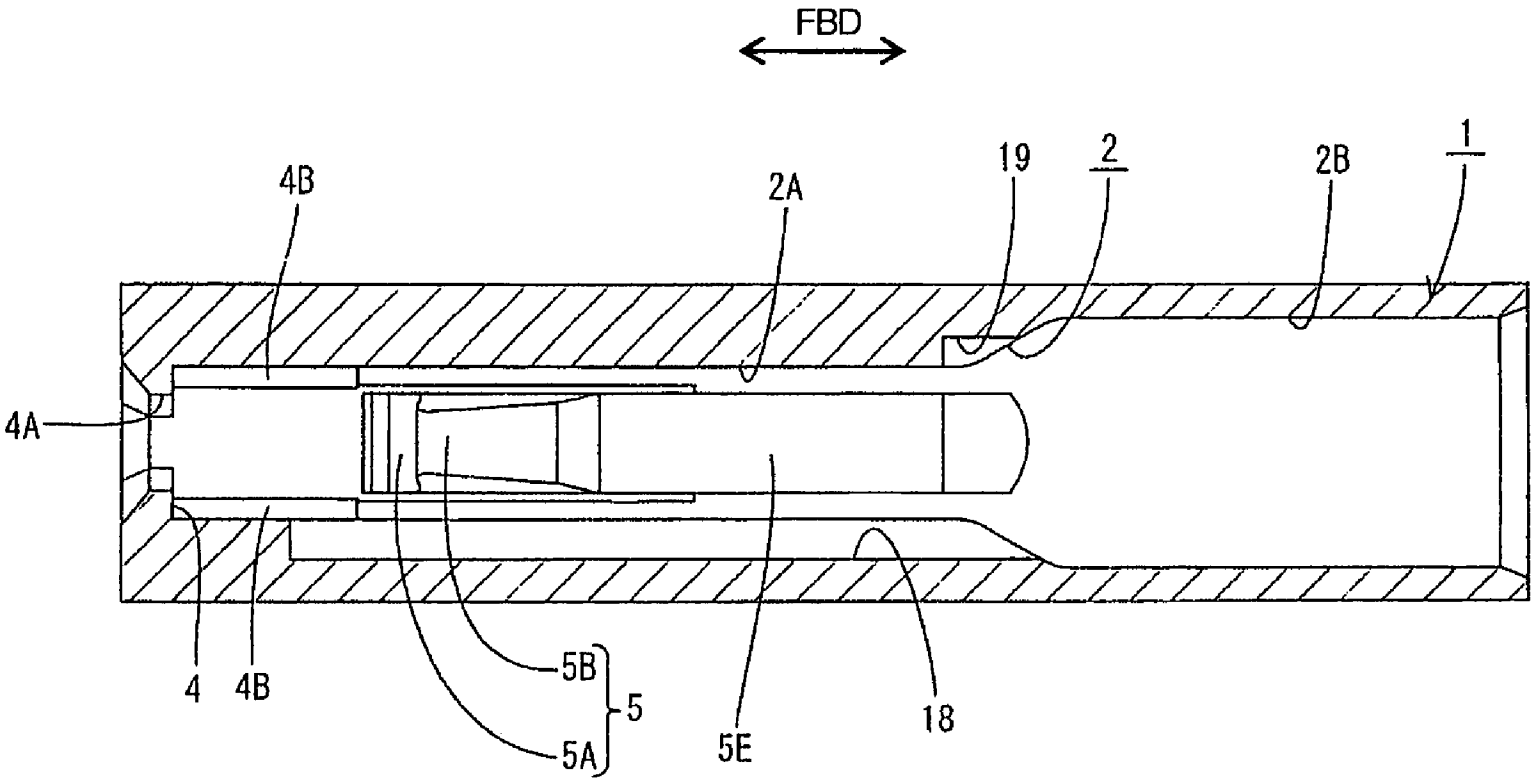
FIG. 8 is a side view in section showing a cavity viewed from above.
Figure 9:
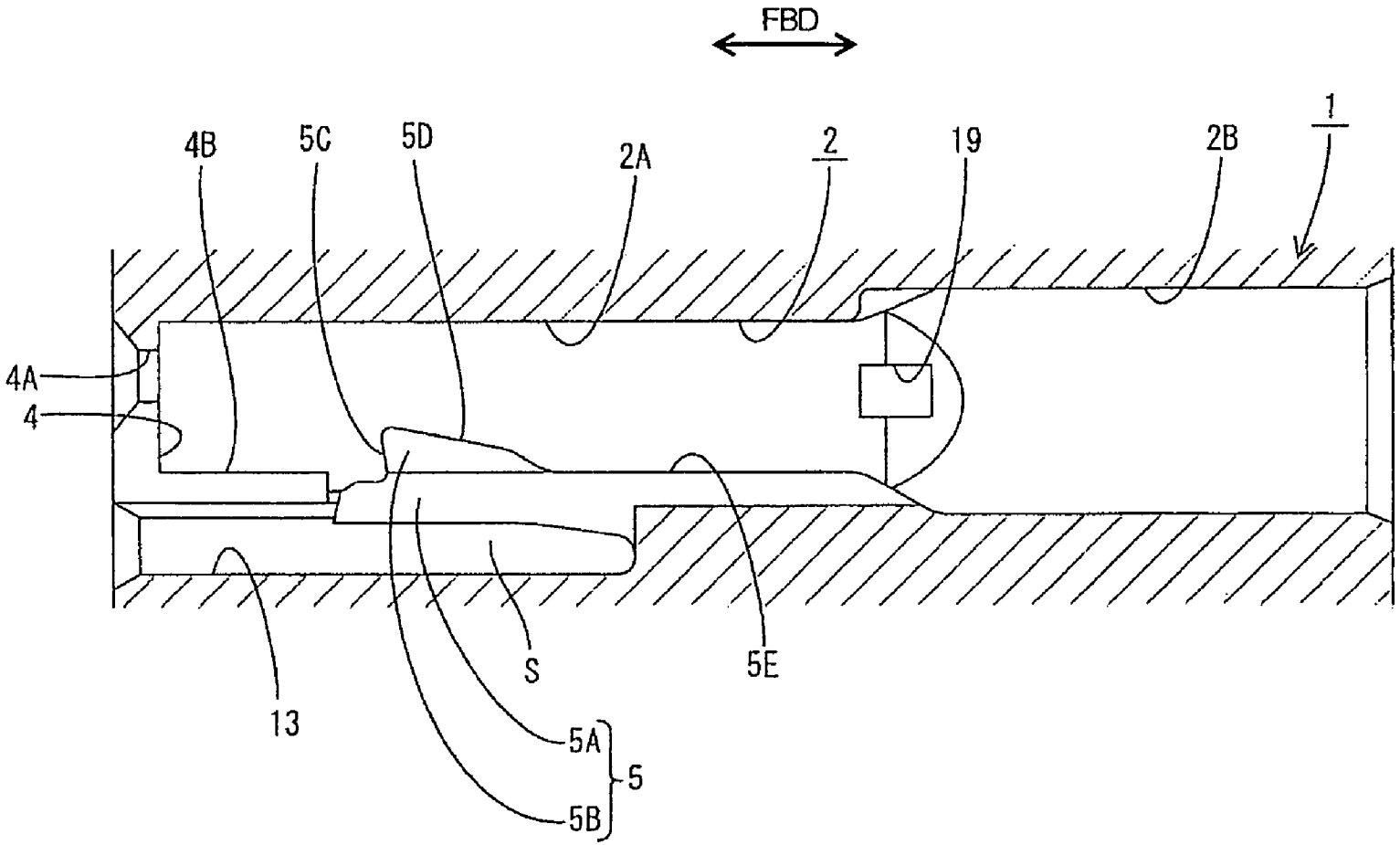
FIG. 9 is a longitudinal section showing the cavity viewed sideways.
Figure 10:
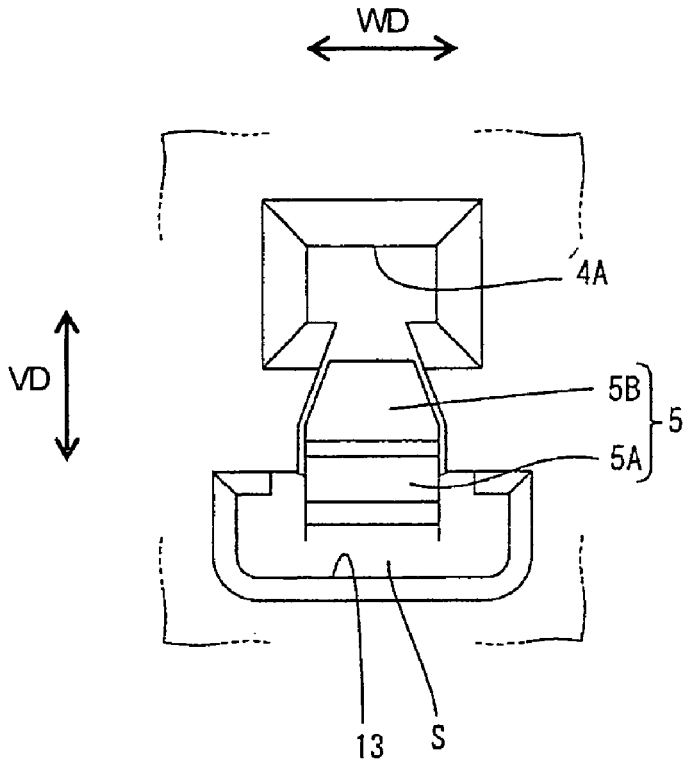
FIG. 10 is a partial front view of the connector.

The deformation space S opens in the front surface of the housing 1 to define a jig insertion hole 13 that communicates with the male tab insertion hole 4A. An unlocking jig (not shown) can be inserted through the jig insertion hole 13 to deform the lock 5 and to cancel the locked state of the terminal fitting 3. As shown in FIG. 8, the jig insertion hole 13 communicates with the inside of the terminal accommodating hole 2A. Thus, the lock 5 can be seen from the front, as shown in FIG. 10. Two supporting surfaces 4B bulge out from the opposite widthwise sides of the terminal accommodating hole 2A between the jig insertion hole 13 and the terminal accommodating hole 2A for preventing the terminal fitting 3 from falling down.

The main portion 6 of the terminal fitting 3 has a bottom wall 6A, opposite side walls 6B, 6B project up from the opposite side edges of the bottom wall 6A and an upper wall 6C that is opposed to the bottom wall 6A. The upper wall 6C is formed by bending upper parts of the opposite side walls 6B inward and placing bent parts one substantially over the other. The lower panel of the double-layered upper wall 6C is embossed inwardly to form a contact projection 6D that extends in the longitudinal direction, as shown in FIG. 1. On the other hand, a resiliently deformable tongue 14 is folded back at the front edge of the bottom wall 6A. Cuts are made in the opposite side surface portions 6B of the main body 6 at positions substantially corresponding to the opposite widthwise edges of a front edge 14D of the tongue 14, thereby exposing the front edge 14D to the outside.

The tongue 14 has an embossed section with a dome-shaped contact point 14A projecting up towards the contact projection 6D, as shown in FIG. 1. A distance between the contact projection 6D and the contact point 14A is set so that the male tab is sandwiched resiliently between the contact point 14A and the projection 6 upon insertion into the main portion 6 through the male tab insertion hole 4A. Further, two preventing pieces 14B bulge out at the opposite widthwise sides of the contact point 14A of the tongue 14. The rear extending end 14C of the tongue piece 14 is bent slightly up.

The locking hole 12 extends over substantially the entire width in the bottom surface portion 6A of the main portion 6. The locking projection 5B has a forwardly inclined overhanging or undercut front end surface 5C and a slanted surface 5D having a moderate downward inclination towards the back from the upper edge of the front end surface 5C. The front end surface 5C of the locking projection 5B engages the front edge 12A of the locking hole 12 when the lock 5 is inserted through the locking hole 12 and into the main portion 6 to prevent the terminal fitting 3 from coming out back in the withdrawal direction.

Figure 4:
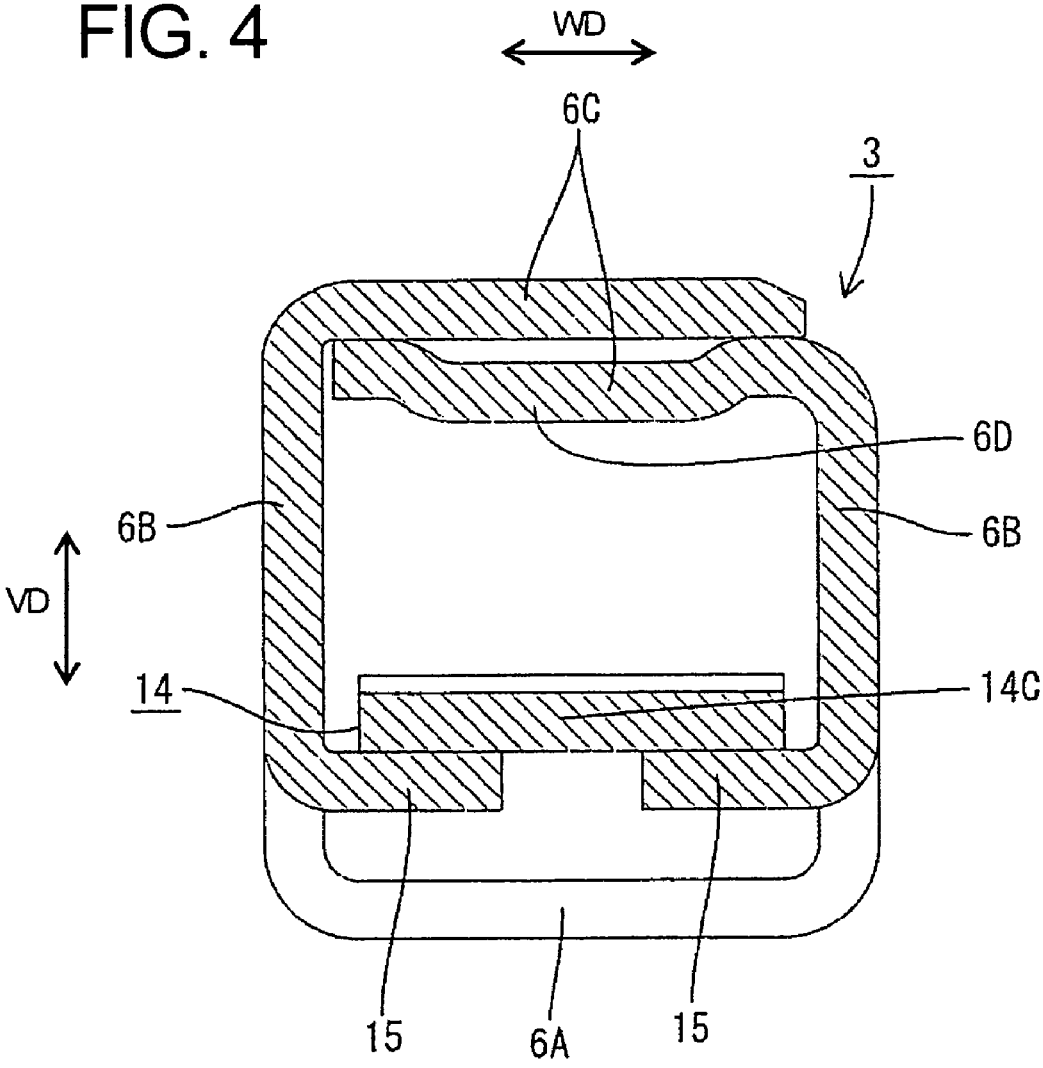
FIG. 4 is a section along IV-IV of FIG. 1.
Figure 5:
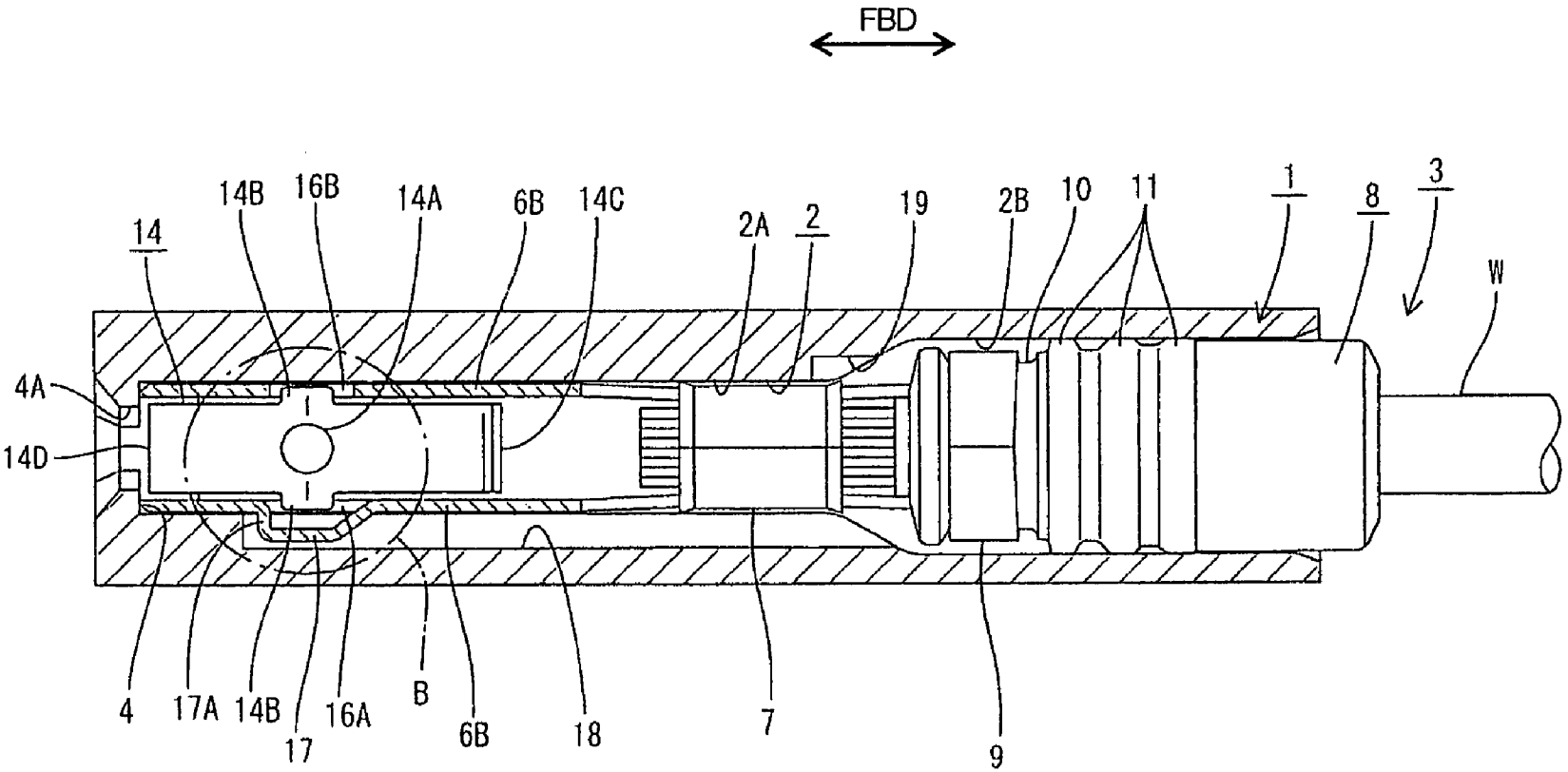
FIG. 5 is a side view in section showing a state where a preventing piece is located inside a stabilizer.
Figure 6:
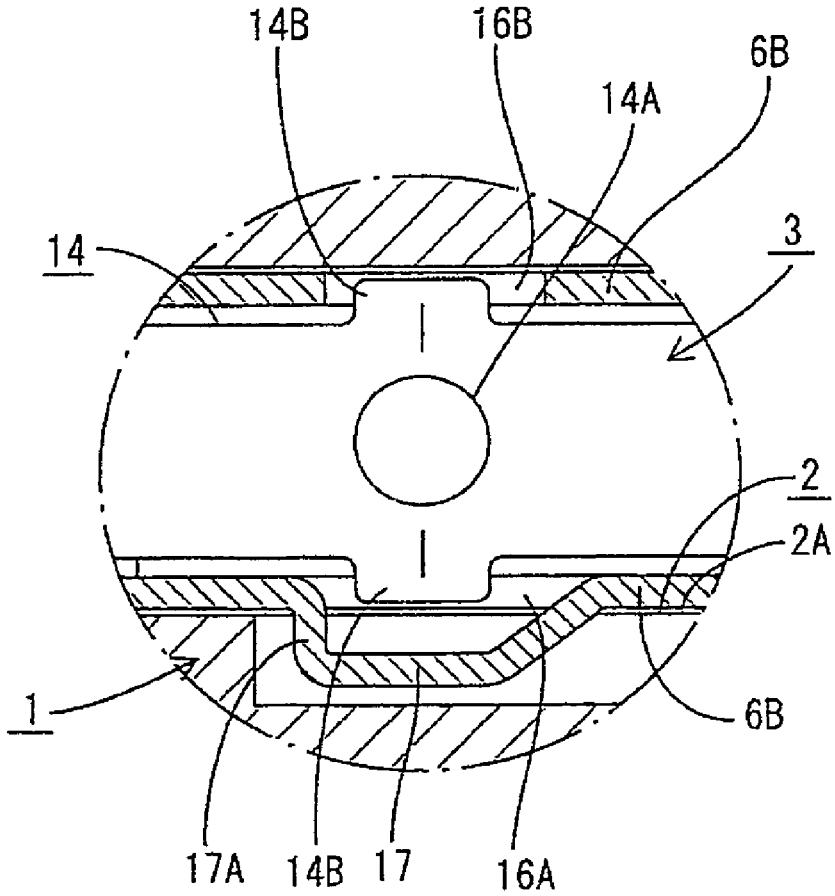
FIG. 6 is an enlarged view of a portion B in FIG. 5.

Supports 15 project from the opposite side walls 6B and raise the rear end of the locking hole 12 from the bottom wall 6A of the main portion 6. The supports 15 support the extending end 14C of the tongue 14 when the male tab is inserted, and engagement margins with the extending end 14C are formed by bending sections from the bottom wall 6A to the side walls 6B inward, as shown in FIG. 4. The extending end 14C contacts with the upper surfaces of the supports 15 of this embodiment even before the male tab is inserted. The length of the supports 15 in forward and backward directions FBD is set such that the extending end portion 14C is supported on the upper surfaces of the supports 15 until the male tab is inserted to a proper position. In other words, the tongue 14 is supported at two points, i.e. at the front edge 14D and at the extending end 14C. Therefore a contact pressure with the male tab can be strengthened to improve contact reliability as compared to a case where the tongue 14 is supported only at the front edge 14D.

The locking projection 5B engages the front edge 12A of the locking hole 12 and receives a shear force in forward and backward directions FBD when the terminal fitting 3 is pulled back in the withdrawal direction. A holding force against the backward withdrawal of the terminal fitting 3 is increased by extending a dimension of the locking projection 5B maximally in forward and backward directions FBD at a height where the shear force is received so that a sectional area against the shear force is enlarged. The locking projection 5B is formed so that the rear end of the slanted surface 5D aligns with the rear end of the opening edge of the locking hole 12. Additionally, the front surface 5C of the locking projection 5B can be before the extending end 14C of the tongue 14 and the rear end of the slant surface 5D of the locking projection 5B can be behind the extending end 14C of the tongue 14 by locating the extending end 14C of the tongue 14 more inwardly than the locking projection 5B. The supporting surfaces 15 are disposed to avoid interference between the slanted surface 5D and the tongue 14. However, the space between the slanted surface 5D of the locking projection 5B and the lower surfaces of the supporting surfaces 15 is minimized. It should be noted that a rear end of the slanted surface 5D is inclined to an extent that the lock 5 can be deformed resiliently into the deformation space S without deforming the front edge 14D of the tongue 14 when the terminal fitting 3 is inserted into the cavity 2 from behind.

Openings are formed in the side walls 6B of the main portion 6 facing the preventing pieces 14B of the tongue 14, and edges of these openings define preventing portions 16A and 16B. The preventing portions 16A, 16B engage the preventing pieces 14B to prevent excessive deformation of the tongue 14, but permit the tongue 14 to deform in the vertical direction VD within its resiliency limit. The second preventing portion 16B is at the left side in FIG. 3 and is formed by boring the left side wall 6B in FIG. 3. The first preventing portion 16A is at the right side in FIG. 3 and is formed by causing a part of the right side wall 6B in FIG. 3 to project out. Specifically, the first preventing portion 16A is formed by making two vertically spaced slits that are long in forward and backward directions FBD. An area between the slits then is embossed to form an outwardly projecting stabilizer 17 for preventing an erroneous insertion of the terminal fitting 3 and for stabilizing its insertion. In other words, the first preventing portion 16A is the edge of the opening made in the right side wall 6B upon forming the stabilizer 17, and the preventing piece 14B is engageable with this opening edge. Thus, the erroneous insertion of the terminal fitting 3 and the excessive deformation of the tongue 14 are prevented at the same position, thereby increasing locations where other functional parts are formed and increasing a degree of freedom in design.

Figure 11:
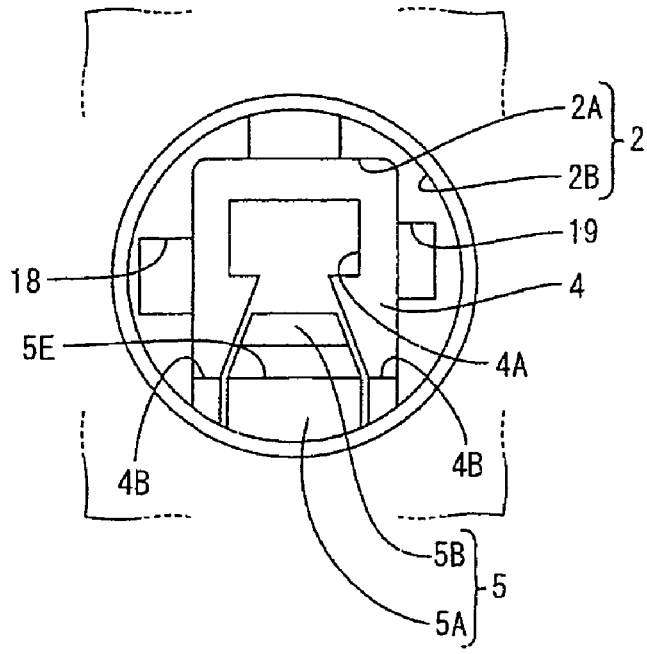
FIG. 11 is a partial rear view of the connector.

As shown in FIG. 7, a front end surface 17A of the stabilizer 17 projects substantially normal to the side wall 6B. As shown in FIG. 11, the inner wall of the cavity 2 is recessed to form a guiding recess 18 at a position facing the stabilizer 17 when the terminal fitting 3 is inserted into the cavity 2 from behind. The guiding recess 18 extends in forward and backward directions FBD from the rear end of the terminal accommodating hole 2A to a position near the front end thereof in the cavity 2, as shown in FIG. 8. On the other hand, a detecting recess 19 is formed at a position substantially symmetrical to the guiding recess 18 with respect to the widthwise center in the cavity 2 by partly cutting a portion near the rear end of the terminal accommodating hole 2A. Thus, when the terminal fitting 3 is inserted into the cavity 2 in a proper posture, the guiding recess 18 receives the stabilizer 17 to permit insertion of the terminal fitting 3. However, the front end surface 17A of the stabilizer 17 contacts the front end surface of the detecting recess 19, if the terminal fitting 3 is in an improper orientation (e.g. upside down), thereby preventing the stabilizer 17 from entering at a position near the rear end of the terminal accommodating hole 2A. Thus, an erroneous orientation of the terminal fitting 3 can be detected.

The terminal fitting 3 is inserted into the cavity 2 from behind. At this time, the guiding recess 18 receives the stabilizer 17 when the terminal fitting 3 is in the proper posture to permit the insertion of the terminal fitting 3 into the cavity 2. However, the front end surface 17A of the stabilizer 17 contacts the front end surface of the detecting recess 19 if the terminal fitting 3 is in the improper orientation (such as upside down) to prevent the erroneous insertion of the terminal fitting 3 and to detect the improper orientation. The front edge 14D of the tongue 14 moves onto the locking projection 5B while the bottom surface portion 6A of the main portion 6 of the terminal fitting 3 slides on the sliding-contact surface 5E of the lock 5. Thus, the lock 5 deforms into the deformation space S. The terminal fitting 3 is pushed further so that the main portion 6 moves forward in the terminal accommodating hole 2A while the front edge 14D slides on the slanted surface 5D. The front end of the main portion 6 is stopped at its front end position by contact with the front wall 4. The lock 5 then restores resiliently and enters the main portion 6 through the locking hole 12. As a result, the front end surface 5C engages the front edge 12A of the locking hole 12 to prevent the terminal fitting 3 from coming out backward.

There are cases where the front end surface 5C of the locking projection 5B receives a shear force from the front edge 12A of the locking hole 12. For example, the wire W may be pulled strongly back in the withdrawal direction with the terminal fitting 3 accommodated in the cavity 2. In such a case, the reference plane B resists shearing since the locking projection 5B is entirely in the locking hole 12. The reference plane B is extended by positioning the extending end 14C up and in as compared to the prior art. Thus, the force for holding the terminal fitting 3 against a rearward pulling force is strengthened. In this respect, the supports 15 keep the extending end 14C of the tongue 14 at a position up and in from the bottom wall 6A of the main portion 6 so that the rear end of the locking projection 5B can be behind the extending end 14C of the tongue 14. Thus, the holding force to prevent the terminal fitting 3 from coming out backward can be enhanced while the terminal fitting 3 is miniaturized. The supports 15 prevent interference between the tongue 14 and the locking projection 5B. Thus, the inclination of the slanted surface 5D can be set to minimize the space between the slanted surface 5D of the locking projection 5B and the bottom of the supports 15. Further, the tongue 14 can be supported at two points, namely the front edge 14D and the extending end 14C. Therefore, connection reliability can be improved by strengthening the contact pressure with the male tab as compared to a case where the tongue 14 is supported only at the front edge 14D.

The housing 1 is connected with the mating housing to connect the male tab and the terminal fitting 3. The male tab is inserted into the main portion 6 through the male-tab insertion hole 4A from the front. The male tab begins resiliently deforming the tongue 14 down in a deformation direction when the leading end of the male tab is about to touch the contact point 14A of the tongue 14. Thus, the tab is sandwiched resiliently between the contact point 14A and the contact projection 6D to be kept in a contact state.

As described above, the front end surface 5C of the locking projection 5B can be located before the extending end 14C of the tongue 14 and the rear end of the slant surface 5D of the locking projection 5B can be located behind the extending end 14C of the tongue 14 by locating the extending end 14C of the tongue 14 more inwardly than the locking projection 5B. Thus, the dimension in forward and backward directions of a portion of the locking projection 5B receiving the shear force from the front edge 12A of the locking hole 12 can be extended. As a result, the sectional area against the shear force can be enlarged. Therefore, the holding force to prevent the terminal fitting 3 from coming out backward is enhanced while the terminal fitting 3 is miniaturized. The supports 15 are above the bottom wall 6A and can engage the extending end 14C of the tongue 14 to prevent interference between the locking projection 5B and the tongue 14 at least during the connection with the male tab. Hence, the tongue 14 is supported at two points, i.e. at the front edge 14D and at the extending end 14C, and connection reliability is improved by strengthening the contact pressure with the male tab as compared to a case where the tongue 14 is supported at one point. Further, the support 15 can be provided easily and inexpensively by cutting and bending parts of the side walls 6B above lateral edges of the bottom wall 6A. The two supports 15 are spaced apart in the width direction WD, and support the tongue 14 in a stable posture without twisting.

In addition, the first preventing portion 16A is formed to share the structural portion of the stabilizer 17, which contributes to the miniaturization of the terminal fitting 3 and ensures a location for another functional part to increase a degree of freedom in design. Further, the edges of the slits serve as the preventing portion 16A and can be flat to prevent excessive deformation of the tongue 14 more stably. Furthermore, the stabilizer 17 can bulge out farther to improve the erroneous insertion preventing function.

Figure 13:
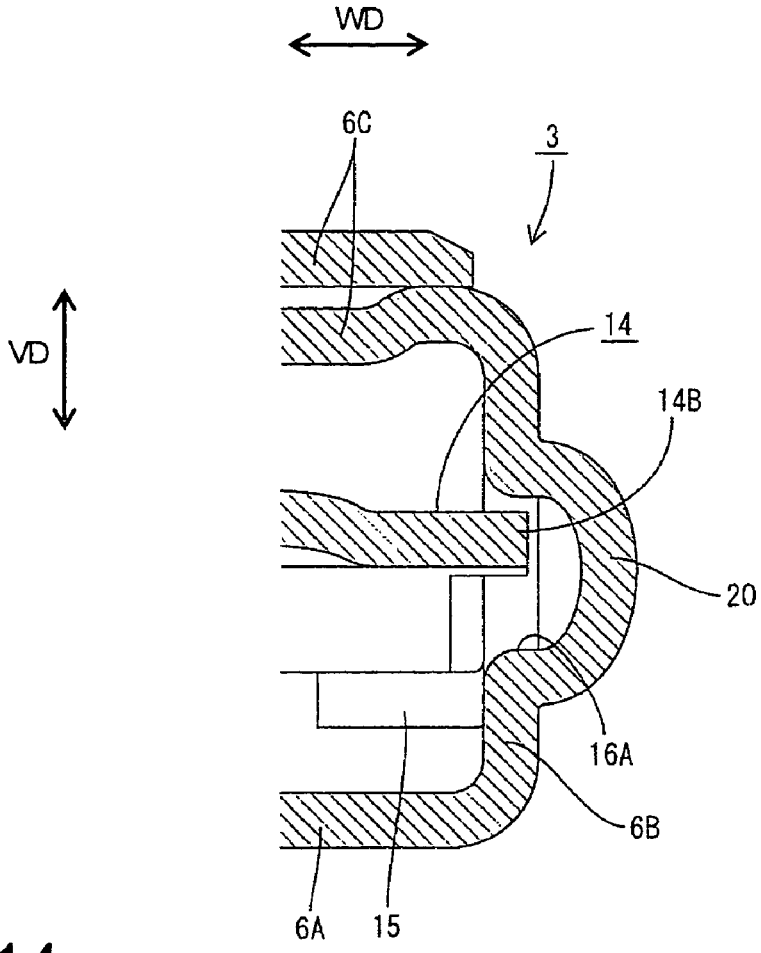
FIG. 13 is a vertical section showing a stabilizer according to a second embodiment.
Figure 14:
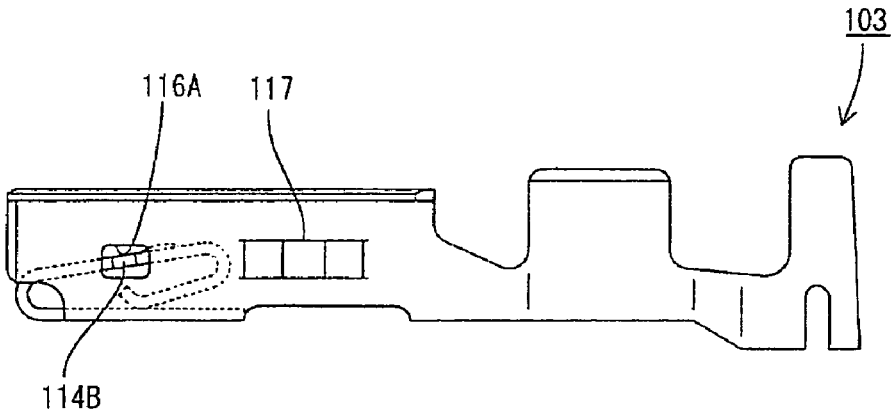
FIG. 14 is a side view showing a terminal fitting in which a stabilizer and preventing portions are separately provided.

A second embodiment of the invention is described with reference to FIG. 13. A connector of this embodiment is obtained by changing the construction of the stabilizer 17 of the terminal fitting 3 of the first embodiment, and other similar constructions are not described. A stabilizer 20 of the second embodiment is embossed to project out without forming a slit. A first preventing portion 16A engages the preventing piece 14B when the tongue 14 is deformed in the vertical direction VD within its resiliency limit, and prevents the tongue 14 from being deformed excessively. In this way, no openings are made in the side wall 6B of the terminal fitting 3, and the stabilizer 20 is formed while leaving the side wall 6*b* closed. Thus entry of external matter can be avoided.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The extending end 14C constantly contacts the supporting surfaces 15 in the foregoing embodiments. However, the extending end 14C may not be in contact therewith in a natural state where no force acts and may be supported thereon as the male tab is inserted.

The tongue 14 is extended back so that the extending end 14C is supported on the supporting surfaces 15, but it may be extended farther back.

The extending end 14C is supported on the supporting surfaces 15 after the connection with the male tab in the foregoing embodiments. However, at least part of the supporting surfaces 15 may be omitted.

The main portion 6 is a rectangular tube in the foregoing embodiments. However, it may have another shape, e.g. a hollow cylindrical shape or elliptical tubular shape or any polygonal shape in cross section provided that it has a substantially tubular shape.

The second preventing portion 16B may be formed differently provided that it is engageable with the preventing piece 14B. For example, a part of the side surface 6B may be embossed to project in from the inner wall of the side surface 6B, thereby forming the second preventing portion 16B to be engage the preventing piece 14B. This can realize the locking construction without boring.

Two preventing portions 16 and two preventing pieces 14B are provided and are spaced apart in width direction WD in the foregoing embodiments. However, it is not always necessary to provide the preventing portions 16 and/or the preventing pieces 14B in pairs provided that they can display the function of prevent excessive deformation of the tongue 14.

What is claimed is:

1. A terminal fitting, comprising:

a substantially tubular main portion for accommodation in a cavity penetrating a housing in forward and backward directions;

a tongue inside the main portion and being resiliently deformable along a height direction;

at least one projection bulging out from at least one widthwise lateral edge of the tongue;

at least one preventing portion formed at a side wall of the main portion substantially facing the projection;

the projection being engageable with the preventing portion to prevent excessive deformation of the tongue, while permitting the tongue to deform within a resiliency limit; and at least one protrusion projecting out from the side wall for preventing an erroneous insertion of the terminal fitting, the preventing portion being formed substantially between the projection and a boundary of the side wall around the protrusion, wherein substantially all peripheral areas of the protrusion are continuous with the side wall with substantially no interruption.

2. The terminal fitting of claim 1, wherein the protrusion is an embossment projecting unitarily out from a part of the side wall.

3. The terminal fitting of claim 1, wherein the protrusion is embossed on a part of the second side wall between two spaced-apart slits.

4. The terminal fitting of claim 1, wherein supports project in from the side walls and are disposed for supporting a portion of the tongue when the tongue is deformed.

5. The terminal fitting of claim 1, wherein the tongue is supported at two portions separated in a longitudinal direction, at least when the tongue is deformed.

6. The terminal fitting of claim 5, wherein the tongue is supported by having an extending end in contact with a support raised from the side wall at least when the tongue is deformed.

7. A connector comprising: a housing, a cavity penetrating the housing in substantially forward and backward directions, and a terminal fitting according to claim 1, the substantially tubular main portion being accommodated in the cavity.

8. The connector of claim 7, further comprising at least one lock in the cavity for locking the terminal fitting in the cavity, the lock having a base and a locking projection projecting from an inner surface of the base in a direction intersecting the forward and backward directions.

9. The connector of claim 8, wherein the locking projection is in a locking hole of the terminal fitting when the lock locks the terminal fitting, so that a reference plane between the base and the locking projection is substantially flush with a plane of opening of the locking hole when the lock is engaged with the terminal fitting.

10. A terminal fitting, comprising:

a substantially rectangular tubular main portion having top and bottom walls and substantially parallel first and second side walls extending between the top and bottom walls, an opening extending entirely though the first side wall from an inside of the tubular main portion to an outer surface thereof, a recess formed in the second side wall substantially opposed to the opening in the first side wall, the recess extending from the inside of the tubular main portion at least partly towards the outer surface thereof;

a tongue inside the main portion and being resiliently deformable towards and away from the top and bottom walls of the tubular main body;

first and second projections bulging out from opposite lateral edges of the tongue, the first projection being engaged in the opening in the first side wall of the main portion without projecting laterally beyond the surface of the tubular main portion, the second projection being engaged in the recess formed in the second side wall of the tubular main portion, engagement of the first and second projections respectively in the opening and the recess of the first and second side walls limiting deformation of the tongue towards and away from the top and bottom walls; and a protrusion unitary with the second side wall and projecting outwardly on the outer surface of the tubular main portion, the protrusion substantially covering the recess in the second side wall, and wherein the first side wall has no protrusion covering the opening therein for maintaining a small cross section for the terminal fitting.

11. The terminal fitting of claim 10, wherein the tubular main portion of the terminal fitting has opposite front and rear ends, the tongue being cantilevered rearwardly from the front end of the terminal fitting and having a free rear end, the bottom wall of the terminal fitting having a locking opening, first and second supports projecting inwardly from the respective first and second side walls at locations substantially aligned with the locking opening, the supports being disposed for engaging the free rear end of the tongue when the tongue is deformed towards the bottom wall, whereby the supports limit deformation of rear end of the tongue, while the first and second projections of the tongue engage the opening and the recess formed respectively in the first and second side walls to limit deformation of portions of the tongue forward of the supports.

12. The terminal fitting of claim 10, wherein the tubular main portion of the terminal fitting has opposite front and rear ends, the protrusion being joined unitarily with the second side wall at locations forwardly and rearwardly of the recess.

13. A terminal fitting for accommodation in a cavity penetrating a housing in forward and backward directions, the cavity being formed with opposite first and second side walls, a guiding recess being formed in the second side wall, the first side wall being formed without a guiding recess, the terminal fitting comprising:

a substantially rectangular tubular main portion having substantially parallel top and bottom walls and substantially parallel first and second side walls extending between the top and bottom walls, a first opening extending entirely though the first side wall from an inside of the tubular main portion to an outer surface thereof, a recess formed in the second side wall substantially opposed to the opening in the first side wall, the recess extending from the inside of the tubular main portion at least partly towards the outer surface thereof;

a tongue inside the main portion and being resiliently deformable towards and away from the top and bottom walls of the tubular main body;

first and second projections bulging out from opposite lateral edges of the tongue, the first projection being engaged in the opening in the first side wall of the main portion without projecting laterally beyond an outer surface of the tubular main portion, the second projection being engaged in the recess formed in the second side wall of the tubular main portion, engagement of the first and second projections respectively in the opening and the recess of the first and second side walls limiting deformation of the tongue towards and away from the top and bottom walls; and a protrusion formed unitarily with the second side wall and projection outwardly on the outer surface of the tubular main portion, the protrusion substantially covering the recess in the second side wall, the first side wall having no protrusion covering the opening therein for maintaining a small cross section for the terminal fitting, the protrusion being slidably received in the guiding recess of the cavity when the terminal fitting is oriented properly for insertion into the cavity and preventing insertion of the terminal fitting into the cavity in an improper orientation.

14. The terminal fitting of claim 13, wherein the tubular main portion of the terminal fitting has opposite front and rear ends, the protrusion being joined unitarily with the second side wall at locations forwardly and rearwardly of the recess.

* * * * *